United States Patent [19]

Dorsch

[11] 4,360,305

[45] Nov. 23, 1982

[54] DISTRIBUTION APPARATUS FOR THROAT CLOSURES OF SHAFT FURNACES, IN PARTICULAR FOR BLAST FURNACE CLOSURES

[75] Inventor: Georg Dorsch, Bad Homburg, Fed. Rep. of Germany

[73] Assignee: Mannesmann DeMag AG, Duisburg, Fed. Rep. of Germany

[21] Appl. No.: 165,418

[22] Filed: Jul. 3, 1980

[30] Foreign Application Priority Data

Jun. 6, 1980 [DE] Fed. Rep. of Germany ..... 2927316

[51] Int. Cl.[3] ..... F27B 1/20

[52] U.S. Cl. ..... 414/208; 193/16; 266/176; 266/183

[58] Field of Search ..... 414/160, 172, 206, 208; 193/16; 266/176, 183

[56] References Cited

U.S. PATENT DOCUMENTS 4,032,024 6/1977 Genge et al. ..... 266/176 X 4,243,351 1/1981 Legille et al. ..... 414/206

*Primary Examiner*—Robert G. Sheridan

*Attorney, Agent, or Firm*—Mandeville & Schweitzer

[57] ABSTRACT

The invention relates to a distribution apparatus for throat closures of shaft furnaces, in particular blast-furnace closures, with a lock chamber arranged within the furnace dome, at the entrance of which is arranged a funnel tube and underneath which, opening out above the charging surface is arranged a distribution pipe which may be swung around the pivot axis by means of a horizontal pair of swivel pins, within a frame, whereby the frame is arranged by means of a hollow shaft or a shaft pin normal to the pivot axis, also extending horizontally and penetrating the furnace dome to which it is sealed and connected to a swing drive, and the pivot drive for the distribution pipe is connected to a drive shaft penetrating the hollow shaft and connected with a pin of the swivel-pin pair.

8 Claims, 5 Drawing Figures

DISTRIBUTION APPARATUS FOR THROAT CLOSURES OF SHAFT FURNACES, IN PARTICULAR FOR BLAST FURNACE CLOSURES

BACKGROUND AND DESCRIPTION OF INVENTION

Such movable distribution pipes serve to load shaft furnaces uniformly and controllably. The mobility of the distribution pipe encompasses two vertical datum planes perpendicular to each other. The distribution pipe either may be moved with the aperture through simultaneous, co-ordinated movements in both datum planes, in closed circular paths of differing diameters, or it may only travel over a part of the charging surface circumference. For each batch of the charge a corresponding angle-position is determined in both datum planes. With the aid of a control, drive motions with shifted phases of the two drives occur which cause the distribution pipe to rotate.

The drive for the distribution pipe and the drive for the swingable frame and their mutual correlation are of considerable importance for such an apparatus. All parts in the furnace space, the functions of which require a motion, are exposed to the dust-laden, hot exhaust gas of the relevant furnace processes and need maintenance.

It is known that in order to fulfill these requirements the drive for the distribution pipe may be designed from a ring gear which has been arranged horizontally, and from a pinion meshing with ring gear, whereby the pinion is non-rotatably connected with the swivel pin of the distribution pipe (DE-OS No. 25 05 026, int. Cl. 2 lb 7/20). In this case it is however necessary to move the circular gear and to provide an axial guide for its proper function, which guide, in the case of the known proposal, consists of pivoted rolls. Such a design requires special sealing of the moving parts which consists of a casing enclosing the moving parts. This solution is therefore very expensive.

The object of the present invention is to create a less expensive apparatus yet requiring a minimum of maintenance. For this class of apparatus, this object is achieved, according to the invention, in such a way that in the drive train for the distribution pipe vertical drive discs are arranged within the frame on each of the drive shaft and pivot pin, which discs are connected with each other by means of power-transmission elements provided on their circumferences. This eliminates a special positioning of the drive discs which need only be non-rotatably connected with the drive shaft and the pivot pin. A special casing is also superfluous. Besides, with such vertical drive discs the space between distribution pipe and frame may be utilized, which without the proposal according to the present invention would be lost space. The frame, based on the proposal according to the invention, may, in other words, also be designed smaller.

It will be easier to design the frame structurally such that the drive discs support each other, which according to one embodiment of the invention would be the case if the drive discs each form peripheral areas which extend below the half angle of the angle formed by the drive shaft-axis and the pivot-pin axis.

Easy to survey power and speed conditions result from another advantageous development of the invention which consists in the fact that the angle of the peripheral areas extends under 45° from the axis of the drive shaft or the pivot-pin axis of the pivot-pin pair.

The principle of the invention may be realized according to which gear ratio and rotating velocities in relation to the circumference of the furnace are desired, for instance with elliptical drive discs. A simple embodiment exists when according to a further characteristic of the invention the drive discs are developed in circular form.

It is possible to further reduce the weight of the apparatus by designing the drive discs in segment shape. The segment angle conforms to the required pivot angles of the distribution pipe.

According to additional advantageous characteristics the power-transmission elements consist of cables, chains or a gear-tooth system in the form of bevel gears. Any of these alternately suggested power transmission elements can be employed as they are considered to be equivalents of one another. Other equivalent structures (neither shown nor stated herein) may be used without departing from the scope of the present invention. These elements require minimal maintenance. Only minimal maintenance work also results from the fact that the drive discs are arranged vertically so that dust mostly falls off as the drive discs spin.

A power transmission between the drive discs suitable to the conditions within the furnace further results when the gear-tooth system is designed along the lines of a mangle gear.

A particularly advantageous embodiment of the invention is designed in such a way that the drive discs have cable grooves, and the discs have angled peripheral areas between the cable grooves, which may be rolled on to each other. Cables, chains and similar means of traction allow for a deflection perpendicular to the traction direction so that it is possible to design a miter gear with these means.

For a reciprocating motion of the drive discs it is further advantageous that the two cables are in parallel grooves carried on the drive discs and the cables extend (in mirror image relative to the horizontal center plane of the two drive discs) across opposite peripheral areas of the respective drive discs. Their ends are each fixed, in opposite directions, to both drive discs and are under tensile stress.

DETAILED DESCRIPTION OF INVENTION

Figure 1:
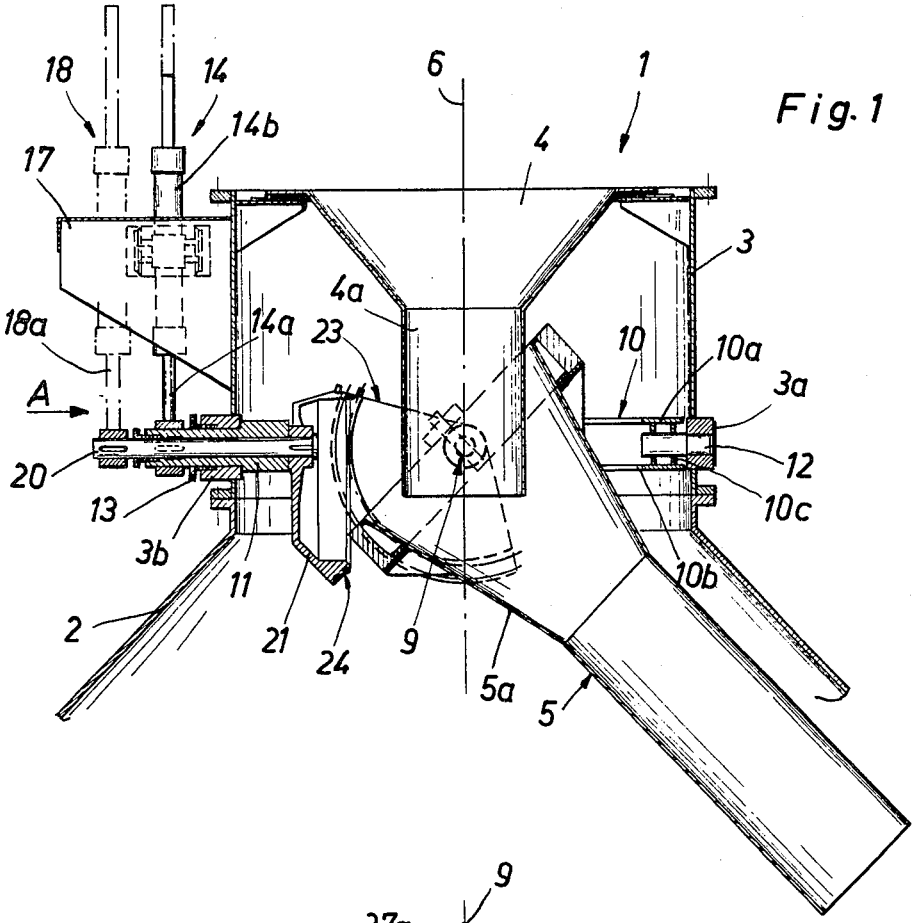
FIG. 1 is a vertical axial section through the center part of a blast furnace throat closure.

The distribution apparatus represents a central or lower structural component of the throat closure 1 of which the upper part has not been drawn. Adjacent to the furnace dome 2 is the cylindrical central part 3, above which is arranged the above-mentioned lock chamber (not drawn). Such a lock chamber serves to prevent gas losses when charging the blast furnace, which is done with gas pressure of 1, 2 bar. At the exit of the lock chamber is a funnel tube 4, the central outlet 4*a* of which opens into the distribution pipe 5. The charging side of the distribution pipe 5 forms a funnel-shaped portion 5*a*, of which the largest circumference is determined by the largest (drawn in FIG. 1 or FIG. 3) deflection of the central vertical axis 6.

Figure 2:
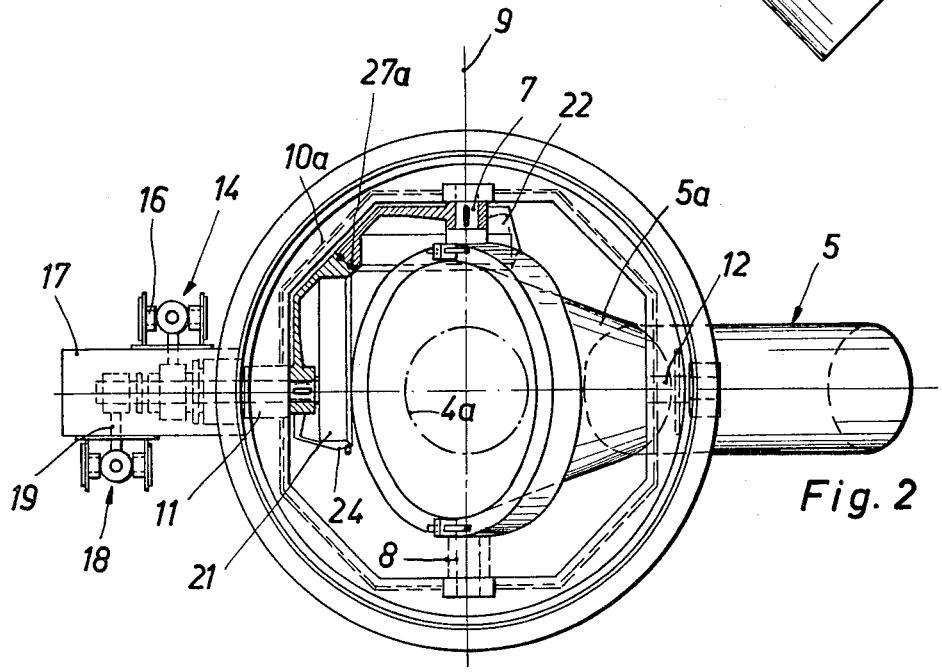
FIG. 2 is the plan view pertaining to FIG. 1.

The funnel tube 4 is fastened to the center part 3 of the throat closure. Pivot pins 7 and 8 which are disposed along the horizontal pivot axis 9, are held in the frame 10, and are fastened to the distribution pipe 5 (FIG. 2). The frame 10 surrounds the funnel-shaped portion 5*a* of the distribution pipe. It is in the shape of a polygon and is itself pivoted by means of the hollow shaft 11 and the pivot pin 12 are mounted in the center part 3; it is sealed in the furnace dome 2.

Figure 3:
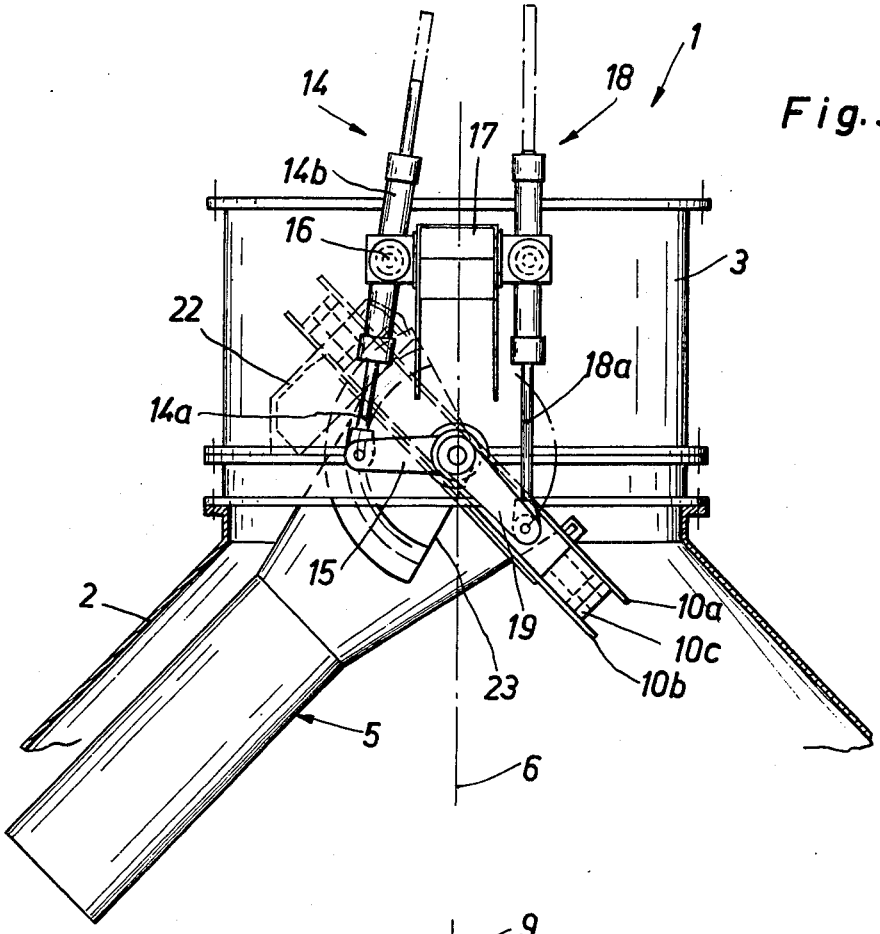
FIG. 3 is a view of the center part of the throat closure per FIG. 1 in direction A, as indicated in FIG. 1.

In the drawn embodiment the frame 10 consists of 2 rings 10*a*, 10*b* which through flanges, 10*c* form a unit, whereby the hollow shaft 11 and the pivot pin 12 are fastened in the flanges 10*c*. The pivot bearings 3*a* and 3*b*, which are equipped with sealant 13, are positioned adjacent the furnace dome 2 at the center part 3. Also fastened to the hollow shaft 11 is the piston cylinder drive 14 with its piston rod 14*a* above the lever 15 (FIG. 3). The cylinder casing 14*b* is fastened to the bracket 17 by means of the pin joint 16. The bracket 17 itself is rigidly arrannged at the center part 3.

Figure 4:
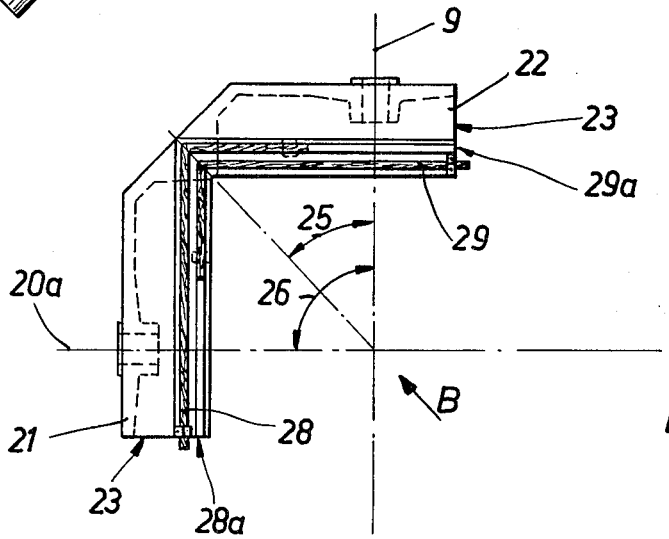
FIG. 4 is an embodiment of the two drive discs according to the invention seen from above, somewhat enlarged.

The drive train for the distribution pipe 5 consists of the additional cylinder drive 18, the piston rod 18*a* above the lever 19 which is non-rotatably connected with the drive shaft 20. Instead of the piston-cylinder drives 14 and 18, electric linear drives, for instance consisting of electric torque motor and toothed rack, may be used. At the other end of the drive shaft 20 is a first drive disc 21 which is within the frame 10, arranged non-rotatably, which is in frictional connection with the second drive disc 22. In the illustrated embodiment example this connection is also formlocked, since the drive discs 21, 22 which are designed in segment-shape 23 form peripheral areas 24 (shown extended in FIG. 5 dash-dotted) which extend below the half angle 25 of the angle 26 formed by drive shaft axis 20*a* with pivot pin axis 9. The angle 26, as drawn, is 90°, the angle 25 is therefore 45°. Consequently, in the tangent 27 (FIG. 5) on the line of contact 27*a* (FIG. 2), the drive discs 21, 22 support each other. The friction caused thereby is however not considered sufficient for an exact transmission of the motion from drive disc 21 to drive disc 22. For that reason power-transmission elements between drive discs 21 and 22 are provided. In the illustrated embodiment examples these consist of cables 28 and 29 which are carried in cable grooves 28*a* and 29*a* (FIG. 4). The cables 28 and 29 are carried in such a manner that they (FIG. 5) extend in mirror image relative to the horizontal center plane 30. This means that cable 28 changes over from drive disc 21 in tangent 27 to drive disc 22 and cable 29 in tangent 27 is carried from drive disc 22 to drive disc 21. At that point cable end 28*b* is firmly connected by tractive force with drive disc 21 and the pertaining cable end 28*c* is firmly connected with drive disc 22. For each of the connections tensioning locks 31 and 31*a* are provided.

Similar thereto, cable end 28*b* is under tractive force and firmly connected with the drive disc 22 and cable end 29*c* firmly connected with drive disc 21. For each of these connections tensioning locks 32 and 32*a* are provided.

According to the crosswise course of the cables 28 and 29 bracing occurs in such a way that in both rotating directions of drive shaft 20 a transmission of forces free from play occurs in one and in the opposite direction.

Figure 5:
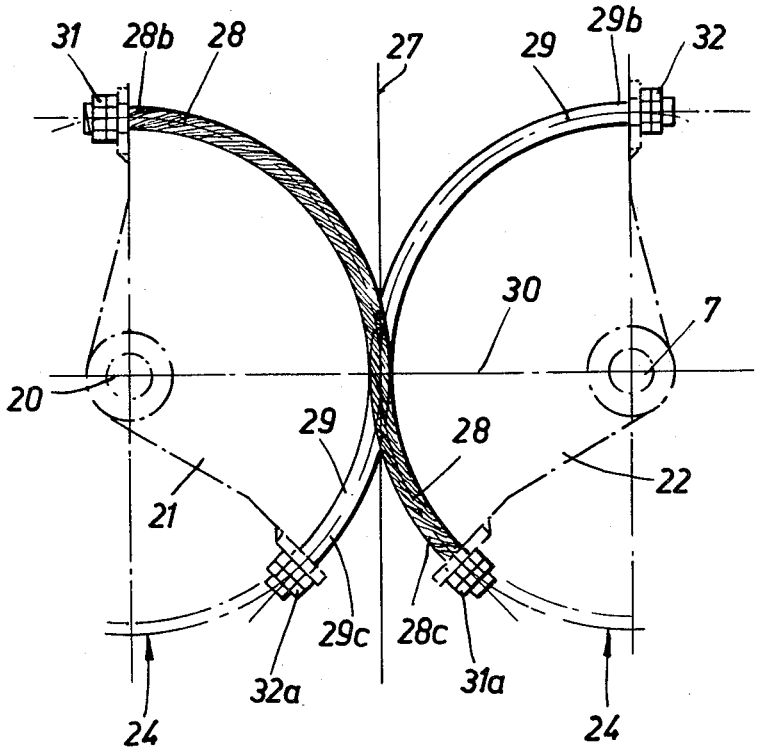
FIG. 5 is a side view of the drive discs per FIG. 4 in direction B, whereby the drive discs are shown folded into the drawing area.

When viewing FIG. 5 it should be added that the cables 28 and 29 in tangent 27 experience a deflection according to angle 26 (FIG. 4). Comparable effects to the cables 28 and 29 may be achieved with by chains or gear teeth in particular for instance a bevel gear. When viewing FIG. 5 it is further to be noted that the two cables 28 and 29 are tandem positioned on different levels. The "crossing" of the cables therefore only takes place in the projection. Another guide for the cables is thereby, however, not precluded.

I claim:

1. A distribution apparatus for the top closures of shaft furnaces having furnace domes comprising:

(a) a funnel tube arranged at the entrance of said furnace dome;

(b) a distribution pipe extending below said funnel tube and capable of selectively directing charge material to a charging surface;

(c) said distribution pipe being pivotally supported by a pair of horizontal swivel pins to thereby enable said distribution pipe to swing about a horizontal axis passing through said swivel pins;

(d) a frame element supporting said swivel pins;

(e) said frame element being supported by a hollow shaft extending perpendicular to the horizontal axis passing through said swivel pins;

(f) said hollow shaft passing through said furnace dome;

(g) a swing drive connected to said hollow shaft for selectively rotating said distribution pipe about the axis passing through said hollow shaft;

(h) a pivot drive passing through said hollow shaft;

(i) said pivot drive having a first vertical drive disc;

(j) a second vertical drive disc connected to one pin of said pair of swivel pins; and (k) power transmission elements serving to couple said first and second drive discs so that rotation of said pivot drive causes said distribution pipe to swivel about said horizontal swivel pins.

2. A distribution apparatus as claimed in claim 1 wherein:

(a) said first and second drive discs have peripheral areas which extend below one half of the angle formed by the axis of the hollow shaft and said one pin of said pair of swivel pins.

3. A distribution apparatus as claimed in claim 2 wherein:

(a) said angle is 90°.

4. A distribution apparatus as claimed in claim 2 wherein:

(a) said first and second drive discs are circularly shaped.

5. A distribution apparatus as claimed in claim 2 wherein:

(a) said first and second drive discs are segmentally shaped.

6. A distribution apparatus as claimed in claim 1 wherein:

(a) said power transmission elements are cables.

7. A distribution apparatus as claimed in claim 1 wherein:

(a) said drive discs are provided with cable grooves such that the angled peripheral areas between said cable grooves can be rolled on to each other.

8. A distribution apparatus as claimed in claim 7 wherein:

(a) a cable is provided in each groove of said drive discs, said cable extending in mirror reflection relative to the center plane of said drive discs and across opposite peripheral areas of said drive discs;

(b) said cables having one of their ends fixed to each drive disc; and (c) said cables are maintained under tension.

* * * * *